United States Patent [19]

Pandell

[11] 3,994,109

[45] Nov. 30, 1976

[54] MULTI-GLAZED WINDOW

[75] Inventor: Rune Pandell, Korsor, Denmark

[73] Assignee: Scanglas A/S, Korsor, Denmark

[22] Filed: Dec. 2, 1975

[21] Appl. No.: 636,918

[30] Foreign Application Priority Data

Dec. 6, 1974 Denmark ..... 6375/74

[52] U.S. Cl. ..... 52/304; 52/616; 428/34

[51] Int. Cl.[2] ..... E06B 3/24

[58] Field of Search ..... 52/616, 656, 398, 399, 52/304, 172; 428/34, 267, 268, 295, 402

[56] References Cited

UNITED STATES PATENTS

| | | | |
|---|---|---|---|
| 3,083,797 | 4/1963 | Wergin | 403/267 X |
| 3,183,560 | 5/1965 | Brichard | 52/656 |
| 3,321,223 | 5/1967 | Snow et al. | 52/656 |
| 3,919,821 | 11/1975 | Goetz | 52/616 |

FOREIGN PATENTS OR APPLICATIONS

| | | | |
|---|---|---|---|
| 634,850 | 1/1962 | Canada | 52/172 |
| 1,013,519 | 4/1952 | France | 52/616 |
| 2,122,679 | 11/1972 | Germany | 52/656 |

*Primary Examiner*—Alfred C. Perham

[57] ABSTRACT

A multi-glazed window having at least two window panes which are spaced apart by a spacer frame consisting of straight rails and angular connecting members in the corners, each of said connecting members having an inclined surface limiting a triangular corner chamber in the frame which is filled with a sealing and/or glueing substance which is injected through a hole in the outer wall of the spacer frame, so that the said triangular corner chamber is completely filled with the said substance, and the cavities in the spacer frame is effectively closed, so that the space between the two window panes can be completely airtight.

2 Claims, 4 Drawing Figures

Fig 1
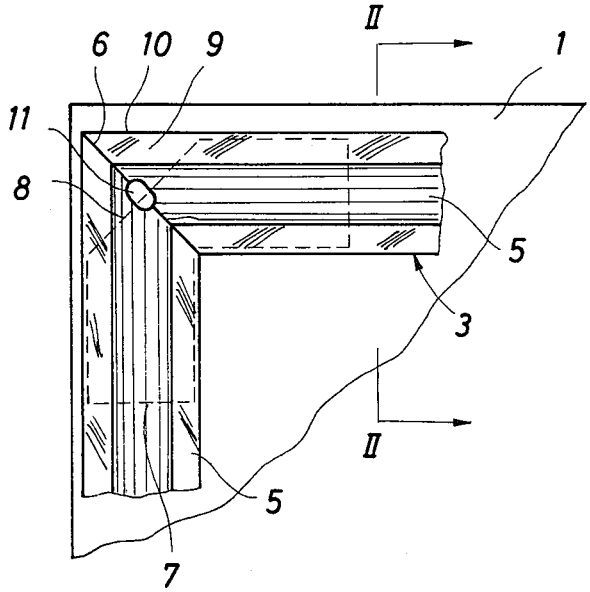
Fig. 2
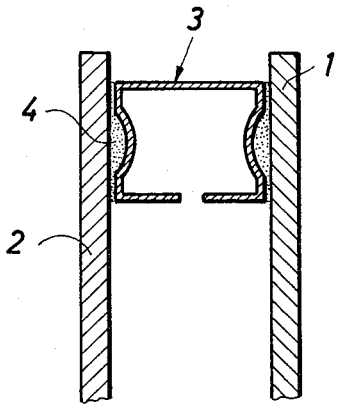
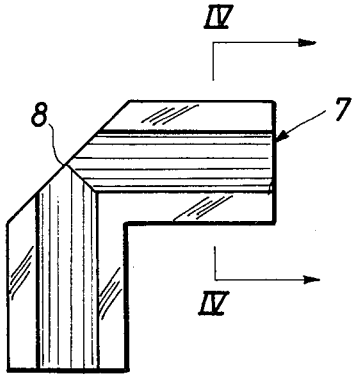
Fig. 3
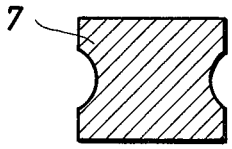
Fig. 4

MULTI-GLAZED WINDOW

The invention relates to a multi-glazed window having at least two window panes between which a spacer frame is arranged consisting of rigid, hollow spacer rails with substantially closed, rectangular cross-section, in the corners the rails being mitre cut and joined edge against edge by means of angular connecting members the legs of which are inserted in the ends of the spacer rails.

When assembled by means of the angular corner pieces the spacer frame constitutes a unit, and between said unit and the window panes a sealing and/or glueing substance is deposited.

It is very important that vapor cannot diffuse into the space between the two window panes, and it has been found that it is not difficult to provide completely effective tightness along the straight portions of the spacer frame. In the corners, however, it is difficult, i.a. because the sealing and/or glueing substance in the corners has a relatively large surface facing the outer atmosphere and therefore may slide out from the window.

From the French Pat. specification No. 1,013,519 is known a multi-glazed window which is assembled by means of inner spacer rails and an outer frame which has a U-shaped cross-section and surrounds the rim portion of the window. In the corners separate triangular cap-like members are mounted, and in corner chambers a sealing substance is deposited.

The window according to this invention is characterized in that each connecting member has an inclined surface which in the spacer frame limits an outer closed corner chamber which is connected to the outer atmosphere through a hole in the spacer frame adapted to inject a sealing and/or glueing substance.

By this construction the spacer frame will be completely tight in the corners, because the sealing and/or glueing substance can be injected in the corner chambers in such a way that complete tightness is obtained in relation to the cavities in the spacer rails as well as in relation to the outer atmosphere.

By the construction according to the invention any outer frame means and closing means are eliminated, so that the outer surfaces of the window are constituted by the surfaces of the window panes and side surfaces of the spacer frame. An outer frame having U-shaped cross-section and separate corner pieces is not used, so that the construction according to the invention is much more simple and cheaper than the known construction. It is further an advantage not to have any means protruding from the surfaces of the window.

It is preferred that in one of the walls of the corner chambers facing a window pane a hole be provided, as thereby it will be possible to control the injection of the sealing and/or glueing substance in the corner chamber in the spacer frame, as the substance during the injection will be pressed against the surface of the window pane which covers the hole.

Complete tightness between the corner chamber and the cavities in the hollow spacer rails of the spacer frame can be obtained if each connecting member is a solid or completely closed member the legs of which have a cross-section which fits the inner cross-section of the hollow spacer rails.

The invention will now be described by way of an example with reference to the accompanying drawing, in which FIG. 1 is a plane view of a corner of a window, FIG. 2 is a cross-section along the line I—I in FIG. 1, FIG. 3 is a side view of a connecting member, and FIG. 4 is a cross-section along the line IV—IV in FIG. 3.

In FIG. 1 a portion of the one window pane 1 for a double-glazed window is shown. In FIG. 2 both window panes 1 and 2 are shown, and a spacer frame 3 arranged between them, which frame may be manufactured by bending an aluminum plate to the box-like profile shown in the figure. Between the spacer frame 3 and the window panes 1, 2 a sealing and/or glueing substance 4 is deposited.

According to FIG. 1 the spacer frame 3 is constituted by straight rails 5 which in the corners are mitre cut under an angle of 45° and mitred, so that the inclined surfaces 6 on the rails abut each other.

The straight rails 5 are interconnected by means of an angular connecting member 7 which in FIG. 1 is shown by dotted lines. The connecting member 7 is a solid body and can be manufactured by injection moulding of a plastic material. As shown in FIG. 4, the connecting member has a cross-section which exactly corresponds to the inner cross-section of the spacer rails 5, so that its two legs may be inserted in the ends of the spacer rails 5, as shown in FIG. 1.

The connecting member has an inclined surface 8, and according to FIG. 1 this surface limits a closed chamber 9 in the spacer frame having a triangular cross-section in the plane of the drawing.

In one of the spacer rails 5 a hole 10 is provided in the outer wall which is perpendicular on the window pane 1, and in at least one side wall of the spacer frame 3 an aperture 11 is provided which is covered by the window pane when the window is assembled, as shown in FIG. 1.

On assembling of the multi-glazed window the window panes and the spacer frame are assembled in conventional manner, and a sealing and/or glueing substance 4 may be deposited between the frame and the panes. Thereafter a sealing substance, which may be of the same kind as the substance 4, is injected through the hole 10, and thereby the corner chamber is filled up with said substance. The filling can be controlled through the aperture 11, and when the sealing substance is pressed against the surface of the pane which covers the apertures 11 the corner chamber is completely filled with the sealing substance, so that complete tightness between the corner chamber and the cavities in the spacer rails 5 is provided, and the inner space in the window between the two window panes 1, 2 will be completely closed. As the hole 10, as shown in FIG. 1, has a small dimension there exists no risk of the sealing substance sliding out of the chamber. Possibly, the hole 10 can be covered by a tape.

I claim:

1. A multi-glazed window having at least two window panes and a spacer frame between said panes, said frame comprising rigid, hollow space rails of substantially closed, rectangular cross-section having their corners mitre cut, and angular connecting members having legs inserted in the ends of the spacer rails for joining said corners of said rails edge against edge, said connecting members being completely solid or closed and at least a portion of their legs having a cross-section which fits tightly in the inner cross-section of said spacer rails, and each connecting member having an inclined surface defining with the spacer frame an outer closed corner chamber, there being a hole in the spacer frame connecting said chamber to the outer atmosphere for the injection of a sealing and/or glueing substance.

2. A window according to claim 1, wherein a second hole is provided in one of the walls of said corner chamber which faces one of said window panes.

* * * * *